US005111939A

United States Patent [19]

Schafer

[11] Patent Number: 5,111,939

[45] Date of Patent: May 12, 1992

[54] SELF-SUPPORTING STACKED DISPLAY AND DISPENSER STRUCTURE

[76] Inventor: Christopher E. Schafer, Rural Route 2, Adair, Iowa 50002

[21] Appl. No.: 628,546

[22] Filed: Dec. 17, 1990

[51] Int. Cl.[5] ..... B65D 21/00

[52] U.S. Cl. ..... 206/503; 206/45

[58] Field of Search ..... 206/503, 45; 229/111, 229/112, 113, 114

[56] References Cited

U.S. PATENT DOCUMENTS

| | | | |
|---|---|---|---|
| 2,269,399 | 1/1942 | Daniel | 229/112 |
| 2,993,631 | 7/1961 | Pasin | 229/112 |
| 3,224,822 | 12/1965 | Kirby | 206/45 |
| 3,369,727 | 2/1968 | Wright | 229/112 |
| 3,804,239 | 4/1974 | O'Brien | 206/803 |
| 3,853,217 | 12/1974 | Scordato et al. | 206/803 |

FOREIGN PATENT DOCUMENTS

| | | | |
|---|---|---|---|
| 1161775 | 9/1958 | France | 206/503 |
| 193780 | 10/1937 | Switzerland | 206/803 |

*Primary Examiner*—Joseph Man-Fu Moy

*Attorney, Agent, or Firm*—Henderson & Sturm

[57] ABSTRACT

The disclosure is of a stacked structure made up of a plurality of identical box-like units arranged one atop the other in a near vertical array in which each unit presents a front face angled to the vertical in such fashion that the front face of each unit forms a dihedral angle with its next lower and next upper unit. Each unit has a floor and a roof that diverge rearwardly relative to each other which causes each upward unit, resting via its floor on the roof of the next lower unit, to tilt forwardly so that its front face is at a lesser angle to the vertical than the angle between the front face of the next lower unit and the vertical. The configuration is such that the increments by which the angles decrease from bottom to top are equal. The units are basically transparent to expose the unit contents and each unit has a dispensing means in its rear part.

9 Claims, 2 Drawing Sheets

SELF-SUPPORTING STACKED DISPLAY AND DISPENSER STRUCTURE

BACKGROUND AND SUMMARY OF THE INVENTION

The present invention relates primarily to a structure for the display and dispensing of game and like tickets. It is fairly conventional to provide dispensers in multiple units so that the units contain and dispense tickets for different games, for example. This gives the customer a choice of games or tickets. Prior stacks, however, required one form or anther of support means; e.g., bracket, etc. It is also known to provide the units or containers of transparent material, such as injection-molded plastic, whereby the tickets are attractively displayed. It is further typical of such dispensers to provide the rear of each unit with a slot or similar means whereby the tickets may be withdrawn manually by the person in charge of the units.

It is the principal object of the present invention to provide a plurality of similar units capable of being stacked in a self-supporting near vertical array, one atop the unit next below, in a multiple of several units that, in total, assembled aspect, present a striking appearance, as well as containing tickets or equivalent contents of different character, thereby increasing the customer's choice of lotteries. The feature of the invention contributing to the novel self-supporting structure is the configuration of each of several identical box-like units so that each unit has a sloped roof on which the floor of the next higher unit rests whereby the center of gravity of the stack is displaced forwardly and, in a more specific sense, the front faces of successive units tilt or are angled relative to the vertical and whereby the front faces are not coplanar, but rather each face forms a dihedral angle with its neighbor.

A further feature of this configuration is that, as to each unit, the front face or wall meets the floor of that unit at a bottom front corner at an angle of less than ninety degrees and the front wall meets that unit's roof at a top front corner at an angle in excess of ninety degrees. The units are stacked with the bottom front corner of the second higher unit directly above the top front corner of the lowermost or base unit and so on upwardly as the units are stacked. Each unit is fixedly adhered floor-to-roof to its neighbor, except as to the floor of the lowermost unit which may be adhered or otherwise affixed to a supporting surface; e.g., a counter etc. The units are preferably formed by injection molding of a suitable plastic and the diverging roof and floor provide adequate draft incident to the molding operation.

Further features and advantages of the invention will become apparent as the disclosure progresses in connection with the appended drawings.

DETAILED DESCRIPTION OF A PREFERRED EMBODIMENT OF THE INVENTION

Figure 1:
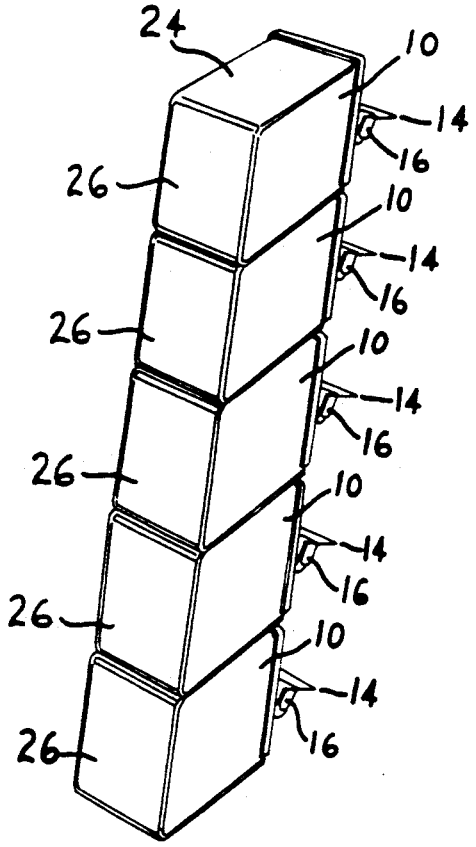
FIG. 1 is a perspective, on a reduced scale, of a stacked array of five units.
Figure 2:
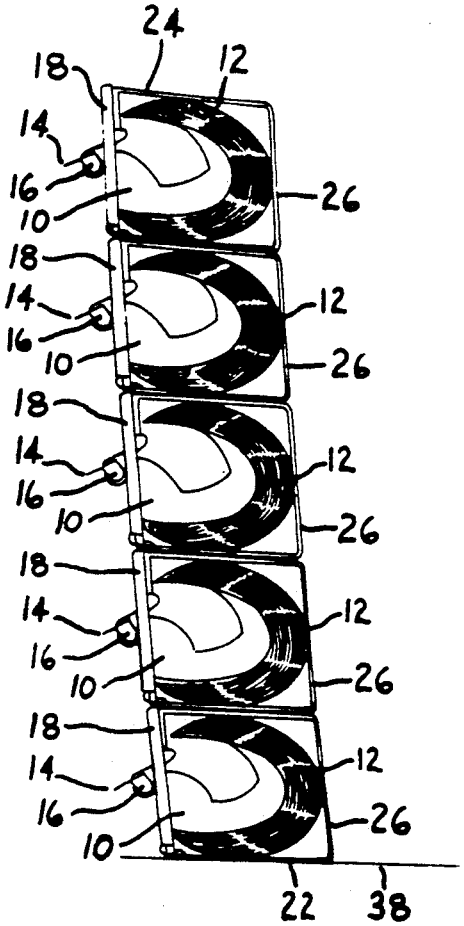
FIG. 2 is an elevation of the stacked array.
Figure 3:
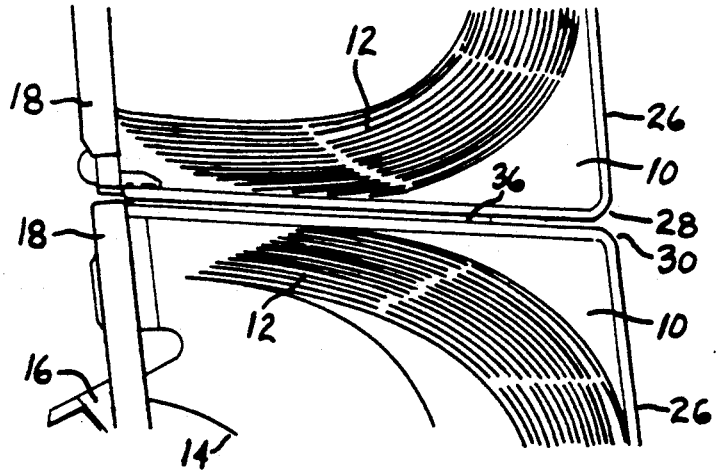
FIG. 3 is an enlarged elevation showing an upper part of a unit and a lower part of a next higher unit.
Figure 4:
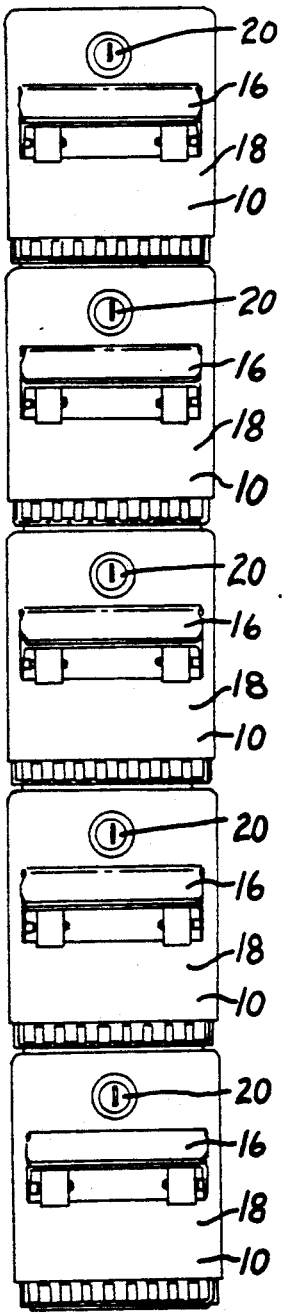
FIG. 4 is a rear elevation of the stacked structure drawn to a scale intermediate those of FIGS. 1 and 3.

Reference will be had initially to FIGS. 1, 2 and 4 for an overview of a selected stacked array of five identical box-like units 10, each of transparent material such as injection-molded plastic so as to make visible to the customer a plurality of sets or books of tickets 12. Each set of tickets is typically of serially-connected tickets which may be dispensed by manually grasping a leading ticket 14 and pulling it rearwardly through exit or dispensing means 16 which may be of any design provided in a rear wall means 18 of each unit, preferably a removable cover normally key-locked in place as at 20.

Figure 5:
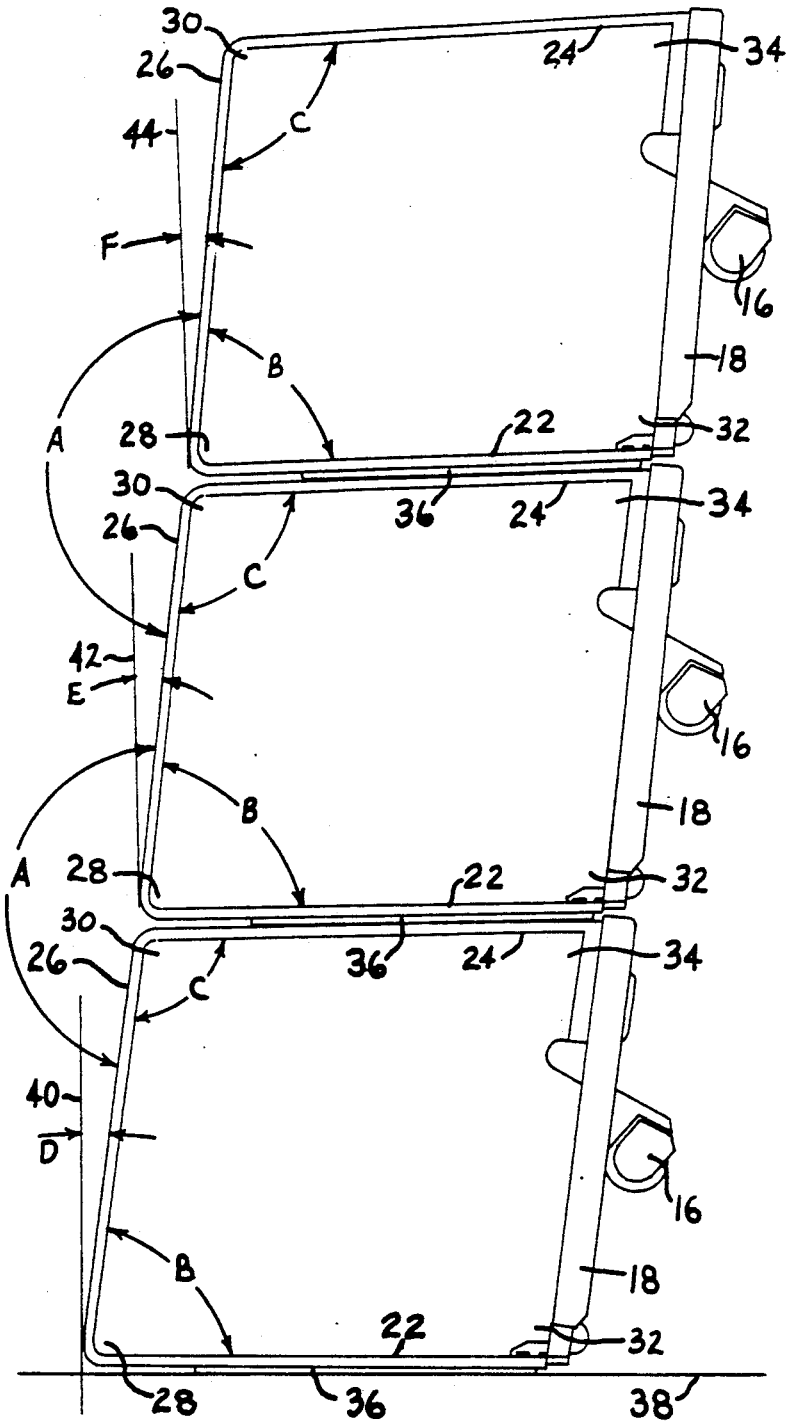
FIG. 5 is an enlarged elevation illustrating the relationship between a lowermost unit and two next higher units.

As best seen in FIG. 5, each unit includes in addition to the rear wall means 18 already referred to, a flat floor 22, a roof 24 and a front wall means or planar face 26. The floor, roof and front face or wall are integral components and the front wall meets the floor at a lower or bottom front corner 28 and meets the roof at a top front corner 30. Bottom and top rear corners 32 and 34 are formed respectively at the junctions of the bottom or floor and roof with the rear wall means 18. Representative dimensions of each unit may be six-by-six-by-six inches, merely by way of example.

When the several units are assembled for use, they are joined together roof-to-floor by any suitable means. Double-adhesive-faced foam tape 36 is a satisfactory means. It is preferred that the stack be fastened to a support surface as by use of another section of tape 36 between the bottom of the floor of the lowermost or base unit and a support such as a counter 38, all details which may be varied without sacrificing the significant aspects of the invention. Other than support on a counter, etc., the units are self-supporting.

The configuration of each unit is such that its floor and roof diverge rearwardly; i.e., they are non-parallel. Although the floor of the base unit is horizontal because its attachment to a horizontal support such as the counter 38, the slope of its roof provides a non-horizontal support for the next higher or second unit, whereby that second unit may be said to have a slight forward "tilt" such that its front face 26 is not coplanar with the front face of the base unit. Nor is the front face of the third unit coplanar with the front face of the second unit. Rather, the relationship of the front faces of neighboring units is such as to form a dihedral angle A (FIG. 5). This results from angles B and C. As seen, angle B at the corner 28 is less than ninety degrees and angle C at the corner 30 is in excess of ninety degrees; representative values will be assigned subsequently herein.

Looking now at the base unit 10 in FIG. 5, a vertical or perpendicular line is shown at 40 and similar verticals appear at 42 and 44 for the second and third units respectively. Considering the front face 26 of the base unit and the vertical 40, it is seen that the face slopes rearwardly away from the vertical by an angle D. The front face of the second unit slopes away from the vertical 42 at a smaller angle E and the front face of the third unit slopes away from its vertical 44 by a still smaller angle F. Thus, the front faces are not coplanar and, as stated earlier herein, each front face forms a dihedral angle A with the front face of its neighbor.

As previously stated, angle B is less than ninety degrees and angle C is greater than ninety degrees. Excellent results have been obtained where angle B is 82.75° and angle C is 98.75°, the sum of the two being 181.50° whereby the dihedrals of the front faces from unit to unit are 178.50°. Angle D in this case is 7.25°; angle E is 5.75°; and angle F is 4.25°. The increments of decrease in the progressively upward angles is 1.5°. Thus, in the case of the fourth unit atop the third unit, the angle to the vertical is 2.75° and the angle for the fifth unit is 1.25°. Because of the combined weights of the tickets 12, the exit means 16 and locks 20, five units is about the practical limit on height to avoid rearward tipping of the assembly. It is also to be noted that the sum of angles B and C exceeds 180° by 1.5°, which is the value of the increments by which the angles E and F decrease upwardly. The excess of the sum of the angles B and C over 180° provides the non-parallelism or divergence of the floor and roof of each unit, also instrumental in providing draft incident to the injection molding operation.

In its broadest aspects, the invention aims at display-enhancing stackability of the units in several multiples to attain a height at which the assembly will not topple and to attain this object without extraneous supports, such as fixtures, brackets, etc. Fundamentally, it is found that this can be achieved where the roof of the unit diverges rearwardly from the horizontal by an angle in the range of about one to four degrees. Further, in this respect, since the assembly relies on roof-to-floor connection, it is important that the roof and floor provide the greatest affixation areas consistent with other dimension of the units. For example, the roof and floor could be shortened front to rear by providing outwardly arcuate or otherwise configured front ends rather than the flat surfaces depicted in the preferred embodiment disclosed here, but this would diminish the affixation areas referred to just above.

Variations in the angles discussed above provide different but still significant results. For example, in an assembly in which the angles B and C are respectively 81° and 101°, angles D, E, and F will be, respectively 9°, 7°, and 5°, the increments between angles being thus 2°. The sum of angles B and C is 182° and the dihedrals A would be 178°. Other variations will suggest themselves without further specific examples. A range of the sums of angles B and C in the order of 181° to 184° will be found suitable where angle B is in the order of 80° to 84°. It is contemplated, of course, that single units could be used alone or with other displays, as well as with companion units. Further variations will occur to those skilled in the art, all without departure from the spirit and scope of the invention.

I claim:

1. A stacked display and dispensing structure comprising:

a base unit of box-like configuration having a floor, a roof, front wall means extending between and fixedly joined to the floor and roof respectively at bottom front and top front corners, and rear wall means extending between and fixedly joined to the floor and roof respectively at bottom rear and top rear corners, the angle between the front wall means and the floor being less than ninety degrees so that the front wall means slopes upwardly and rearwardly from the floor and the angle between the front wall means and the roof being greater than ninety degrees so that the roof slopes upwardly and rearwardly from the front wall means in divergent relation to the floor;

a second unit having a floor and front wall means joined together at a bottom front corner and angle identical to the bottom front corner and angle of the base unit, said second unit being mounted atop the base unit via the floor of the second unit and the roof of the base unit with the second unit bottom front corner directly above the top front corner of the base unit, whereby the planes of the two front wall units meet at a dihedral angle.

2. A structure according to claim 1, in which the second unit is identical to the base unit and includes a roof joined to its front wall means at a top front corner and angle identical to those of the base unit, and a third unit having a floor and front walls means joined together and a bottom front corner identical to those of the base and second units, said third unit being mounted atop the second unit via the floor of the third unit and the roof of the second unit with the bottom front corner of the third unit directly above the top front corner of the second unit, whereby the planes of the front wall means of the second and third units meet at a dihedral angle between the base and second unit front wall means.

3. A structure according to claim 1 in which the sum of the angles at the bottom and top front corners of the base unit is in the range of 181°–184°.

4. A structure according to claim 3, in which the angle at the bottom front corner is in the range of 80°–84°.

5. A structure according to claim 4, in which said angle is about 82.75°.

6. A structure according to claim 4, in which said angle is about 81°.

7. A structure according to claim 1, in which the dihedral angle is in the range of about 179°–176°.

8. A stacked display and dispensing structure comprising:

a base unit of box-like configuration having a flat floor lying in a single plane, a flat roof lying in a single plane and front and rear ends, the planes of the floor and roof diverging rearwardly from front to rear, a second identical unit stacked atop the base unit with the plane of its flat roof and flat floor also diverging rearwardly and with its floor superimposed flat-wise over the entire roof of the base unit, and means affixing the floor of the second unit to the roof of the base.

9. A structure according to claim 8, in which the angle of divergence of the plane of roof from the horizontal is in the range of one to three degrees.

* * * * *